US005666900A

United States Patent [19]

Carroll, III et al.

[11] Patent Number: 5,666,900

[45] Date of Patent: Sep. 16, 1997

[54] METHOD AND APPARATUS FOR DEPLOYING AN EXPENDABLE AUTONOMOUS UNDERWATER VEHICLE FROM A SUBMARINE

[75] Inventors: Alf L. Carroll, III, Wareham, Mass.; William D. Pattee, Santa Barbara, Calif.; Mark C. Manning, Portsmouth, R.I.; John E. Mather, Summerland; Michael P. Wapner, Santa Barbara, both of Calif.

[73] Assignees: Sippican, Inc., Marion, Mass.; Sonatech, Inc., Santa Barbara, Calif.

[21] Appl. No.: 461,744

[22] Filed: Jun. 5, 1995

[51] Int. Cl.[6] ..... B63G 8/00

[52] U.S. Cl. ..... 114/316; 114/238

[58] Field of Search ..... 114/312, 316, 114/238, 317, 318, 319; 367/134

[56] References Cited

U.S. PATENT DOCUMENTS

| | | | |
|---|---|---|---|
| 4,189,703 | 2/1980 | Bennett | 367/134 |
| 4,198,703 | 4/1980 | Huisveld, Jr. et al. | 367/1 |
| 4,854,260 | 8/1989 | Woidich et al. | 114/316 |
| 4,991,144 | 2/1991 | Geren et al. | 367/1 |
| 5,144,587 | 9/1992 | Mason | 367/1 |
| 5,301,096 | 4/1994 | Klontz et al. | 363/37 |

FOREIGN PATENT DOCUMENTS 0 284 777 10/1988 European Pat. Off. .

OTHER PUBLICATIONS

International Search Report for corresponding International Application No. PCT/US96/06886 from European Patent Office acting as International Searching Authority, Sep. 20, 1996, seven pages.

MK39 EMATT brochure, published by Sippican, Inc., about 1993, two pages.

*Primary Examiner*—Jesus D. Sotelo

*Attorney, Agent, or Firm*—Testa, Hurwitz & Thibeault, LLP

[57] ABSTRACT

An expendable autonomous underwater vehicle is deployed from a trash disposal unit of a submarine into a body of water. The vehicle and one or more launch-aiding components are inserted into the trash disposal in an arrangement that results in safe and reliable deployment from the trash disposal unit. The launch-aiding components keep the vehicle in a predetermined orientation within the trash disposal unit prior to deployment and protect the trash disposal unit from damage. The launch-aiding components also aid the vehicle in ejecting from the trash disposal unit and descending into the body of water to a depth at which the vehicle can begin its autonomous operation. In general, the vehicle must be a safe distance away from the submarine before it begins operation. The launch-aiding components fall away from the vehicle in the body of water as the vehicle descends thereinto. The expendable autonomous underwater vehicle, which typically is used by submarine personnel as a training target, drops to the bottom of the body of water after its internal battery is exhausted.

20 Claims, 11 Drawing Sheets

METHOD AND APPARATUS FOR DEPLOYING AN EXPENDABLE AUTONOMOUS UNDERWATER VEHICLE FROM A SUBMARINE

FIELD OF THE INVENTION

This invention relates to expendable autonomous underwater vehicles and, more particularly, to launching safely and reliably such vehicles into a body of water from a trash disposal unit of a submarine.

BACKGROUND OF THE INVENTION

An expendable autonomous underwater vehicle is used to train naval forces in the detection, localization, tracking, and/or attack of a submarine in a body of water (i.e., to train naval forces in anti-submarine warfare). The Expendable Mobile ASW (Anti-Submarine Warfare) Training Target (EMATT) is an example of such an expendable un-manned underwater vehicle available from Sippican, Inc. of Marion, Mass. After being launched into a body of water, the expendable underwater vehicle "swims" a pre-programmed underwater course as it acoustically simulates a submarine. The naval forces use acoustics to detect, localize, track, and/or attack the simulated submarine. After a specified time, currently about three hours, the internal power source of the expendable underwater vehicle becomes exhausted, and the vehicle drops to the bottom of a body of water.

It is known how to launch or deploy the expendable underwater vehicle into a body of water from either a surface ship or an aircraft. When launched by a surface ship, the expendable underwater vehicle is dropped into the water. In an aircraft launch, the expendable underwater vehicle cannot simply be dropped into the water because the impact with the water typically would damage the vehicle. Additional hardware is used in an aircraft launch to help the vehicle survive the impact with the water. The additional hardware typically is referred to collectively as an air launch assembly.

To air launch the expendable underwater vehicle, it is fitted with the air launch assembly, and then the combination typically is packaged in a sonobuoy launch container. The vehicle then can be launched from the aircraft either by using a launching tube on the aircraft that accepts the sonobuoy launch container and automatically upon command ejects the vehicle from the container, or by manually removing the vehicle from the sonobuoy launch container and dropping (launching) the unit through a launching tube or other opening in the aircraft. After the vehicle is launched from the aircraft, the air launch assembly deploys and decelerates the vehicle such that the vehicle enters the water nose-first and along its longitudinal axis.

SUMMARY OF THE INVENTION

It is an object of the invention to deploy safely and reliably an expendable autonomous underwater vehicle into a body of water from a trash disposal unit of a submarine.

It is a further object of the invention to provide an expendable autonomous underwater vehicle particularly adapted for deployment from a submarine. For example, the vehicle preferably has an internal power source that does not present a hazard to the submarine personnel.

In accordance with the invention, the expendable autonomous underwater vehicle is deployed from the trash disposal unit of the submarine into the body of water. The vehicle and one or more launch-aiding components are inserted into the trash disposal unit in an arrangement that results in safe and reliable deployment from the trash disposal unit. The launch-aiding components keep the vehicle in a predetermined orientation within the trash disposal unit prior to deployment and also prevent damage to the trash disposal unit. The launch-aiding components also aid the vehicle in ejecting from the trash disposal unit and descending into the body of water to a depth at which the vehicle can begin its autonomous operation. The launch-aiding components fall away from the vehicle in the body of water as the vehicle descends thereinto.

The vehicle preferably includes an internal seawater battery in a housing having one or more ports therein for allowing, when the vehicle is in the body of water, (i) water to enter, the water acting as the electrolytic contact within the battery, and (ii) gas byproducts to exhaust. The launch-aiding components preferably include means for sealing the ports of the battery housing and keeping the battery dry when the vehicle is confined within the trash disposal unit, or other areas of the submarine, prior to launch and subsequent operation.

The launch-aiding components also preferably include means for increasing an in-water weight of the vehicle to assist in ejecting the vehicle from the trash disposal unit into the body of water. This can be accomplished by a descent weight being placed on a shroud of the vehicle while the vehicle is in the trash disposal unit. When the trash disposal unit is pressurized and a ball valve of the trash disposal unit is opened, the descent weight helps to push the vehicle out of the trash disposal unit into the body of water such that the vehicle descends to a safe distance from the submarine where it can turn on and begin its autonomous operation.

With the invention, submarine personnel can conduct training exercises at their convenience and at any location without relying on or coordinating with a surface ship or an aircraft to have the vehicle launched into the water.

The foregoing and other objects, aspects, features, and advantages of the invention will become more apparent from the following description and from the claims.

BRIEF DESCRIPTION OF THE DRAWING

In the drawings, like reference characters generally refer to the same parts throughout the different views. Also, the drawings are not necessarily to scale, emphasis instead generally being placed upon illustrating the principles of the invention.

DESCRIPTION

Figure 1:
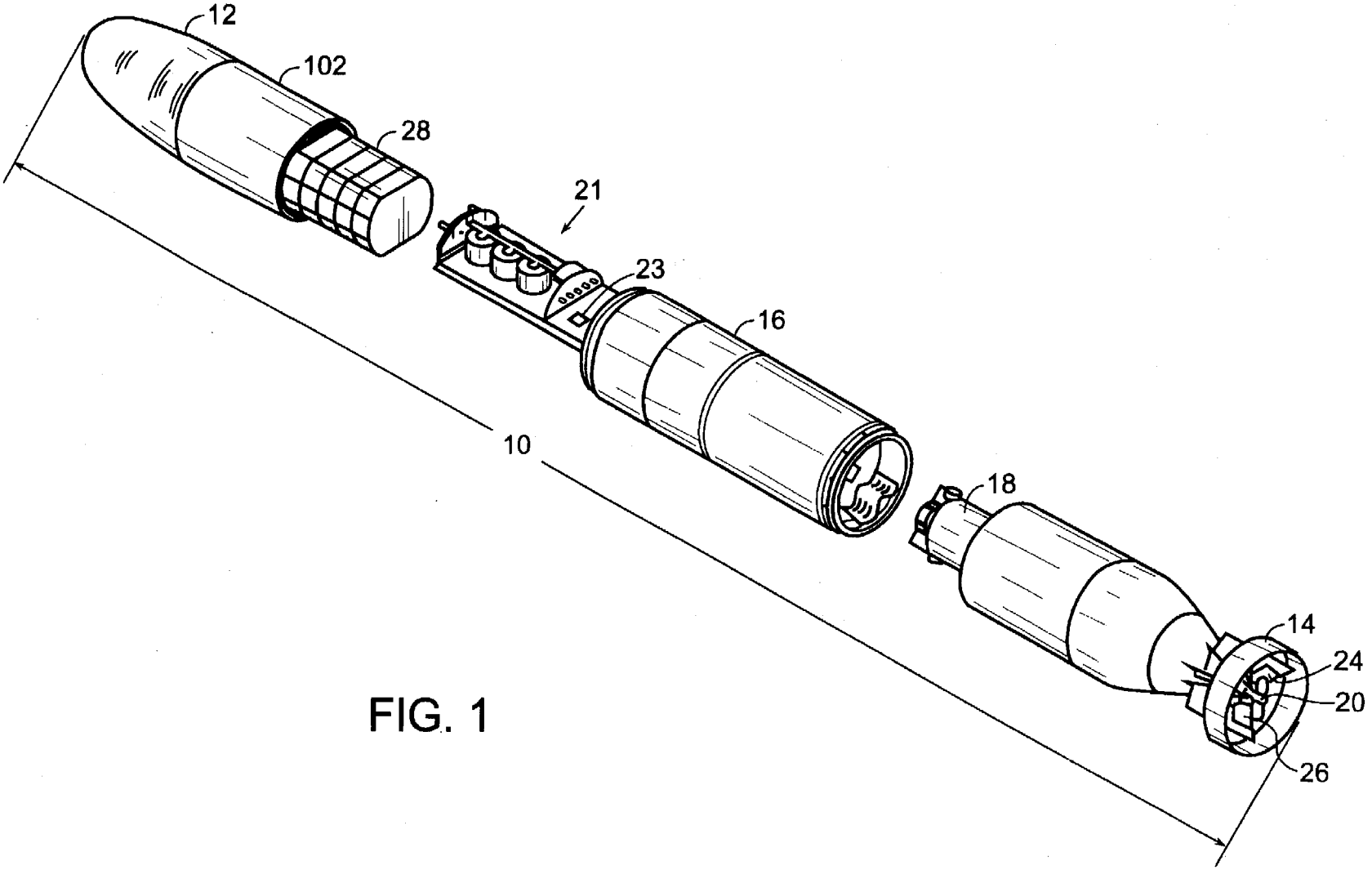
FIG. 1 is an exploded perspective view of an expendable autonomous underwater vehicle which can be deployed from a trash disposal unit of a submarine in accordance with the invention.

Referring to FIG. 1, an exploded perspective view of an expendable autonomous underwater vehicle 10 which can be deployed from a trash disposal unit of a submarine in accordance with the invention. The vehicle 10 is a battery-powered, self-propelled unit which is about 3 to 4 (e.g., about 3.5) feet long, about five inches in diameter at its thickest point, about 25 pounds in weight, and can range up to about 5 feet in length. In training exercises, the vehicle is used to simulate ocean vehicles (e.g., submarines and/or surface ships), and it performs a three-hour pattern at varying depths. After being launched into the water, the vehicle becomes energized and performs various simulation activities.

The expendable autonomous underwater vehicle 10 is generally configured as an elongated member having a nose 12 at a front end a shroud 14 at a rear end, and a generally watertight compartment 16 therebetween. A battery housing 102 around a battery 28 has ports of holes 84 therein and therefore is not watertight unless the holes 84 are plugged. Two ways of plugging the holes 84 are described hereinafter. Within the compartment 16 lies a DC brush motor 18 for driving a propeller 20, located adjacent the shroud 14. Also contained within the compartment 16 is the vehicle electronics system 21, and a speed control chip 23, for implementing a predetermined course by controlling the motor 18 which causes the vehicle 10 to follow the course by moving elevators 24 and rudders 26. Between the compartment 16 and the nose 12, is the battery 28, preferably a seawater battery 100. The battery 28 provides power to the vehicle electronics system 21 and the motor 18 and generally also to any other components of the vehicle 10 requiring power. The internal structure of the vehicle is further described below with reference to FIG. 6.

In a preferred embodiment of the invention, the expendable autonomous underwater vehicle 10 is a SUBMATT™ vehicle available from Sippican, Inc. of Marion, Mass.

Figure 2:
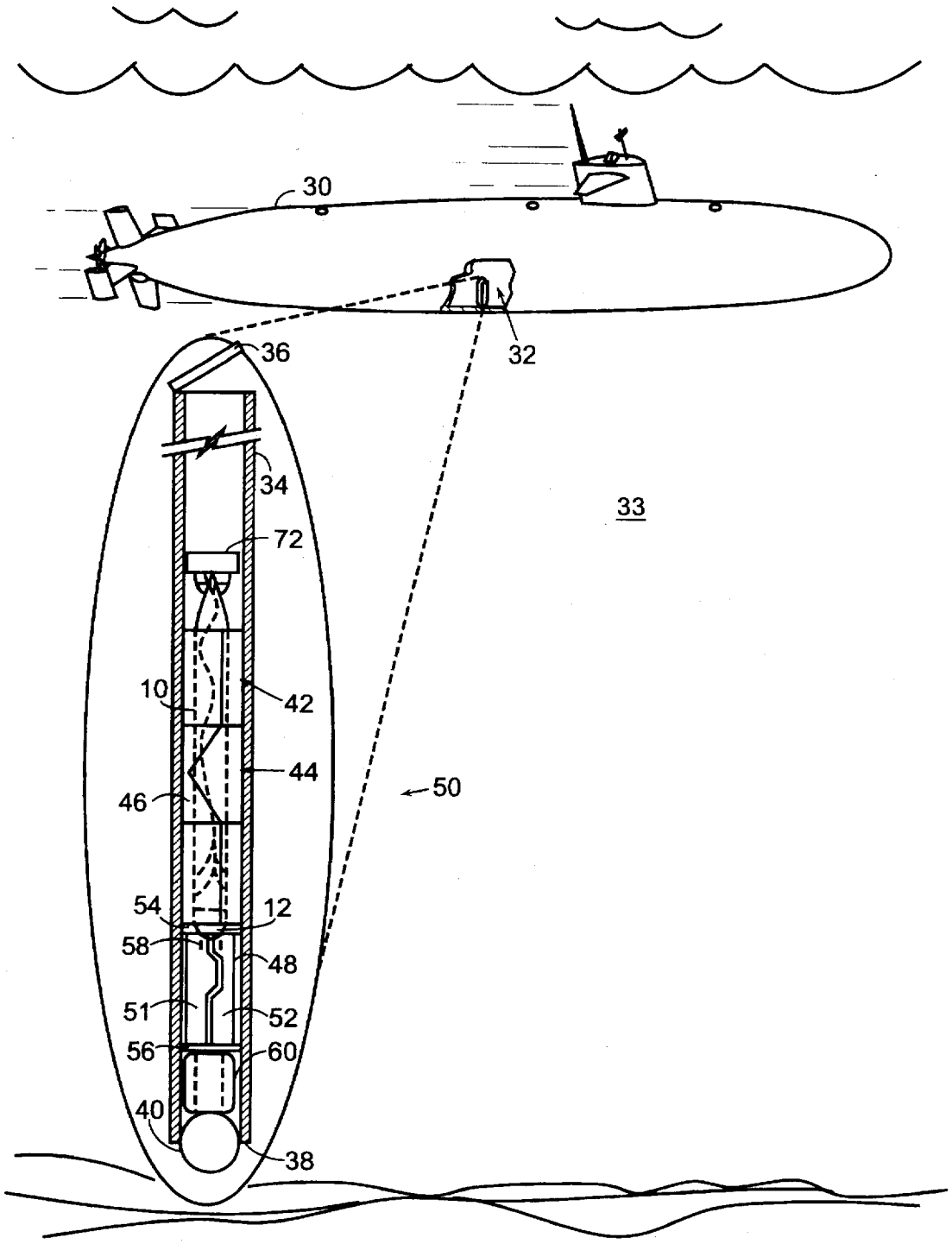
FIG. 2 is a diagram of a submarine in a body of water with a portion broken away to reveal the vehicle of FIG. 1 loaded into the trash disposal unit of the submarine, the trash disposal unit appearing enlarged to indicate more clearly the configuration of the vehicle and various launch-aiding components within the trash disposal unit.

As shown in FIG. 2, the vehicle 10 is launched into a body of water 33 from a trash disposal unit (TDU) 32 of a submarine 30. While it is presently preferred that the vehicle 10 be launched from the TDU 32, it also is possible to launch the vehicle 10 from any means on the submarine capable of discharging objects or materials from the submarine 30 into the water. A trash disposal unit on a submarine typically is used to discharge waste. In accordance with the invention, the TDU 32 is used to discharge the vehicle 10 into the water 33. In general, the structure and shape of the trash disposal unit 32 is such that it safely accommodates and launches the vehicle when certain launch-aiding components are employed.

The trash disposal unit 32 generally comprises an elongated tube 34 of a diameter sufficient to completely enclose the vehicle 10. At the top end of the trash disposal unit 32 is a breech door 36 which when open, allows insertion of the vehicle 10, and when closed, provides an air tight closure. This is important, as once the vehicle 10 has been inserted and is ready for launching, the trash disposal unit 32 is pressurized, as further discussed with reference to FIG. 3E. At the bottom end of the trash disposal unit 32, nearest the exit 38, is a ball valve 40 which aids in launching the vehicle 10 into the water. The ball valve 40 remains in a closed position while the vehicle 10 is within the trash disposal unit 32.

In order to prevent the trash disposal unit or the vehicle 10 from being damaged, it is important that the vehicle 10 be secured within the TDU 32 in an upright, vertical position such that it cannot move around as the submarine moves through the water. Properly maintaining the vehicle within the TDU ensures safe and reliable launching and also prevents damage to the TDU when the vehicle is contained therein. In order to maintain proper orientation of the vehicle 10, the vehicle 10 is placed in a sub-launch assembly 50 during a pre-launch stage. The sub-launch assembly 50 comprises various launch-aiding components 42, 48, 60, and 72 which are sized to fit within the trash disposal unit 32.

A centering collar 42 is disposed in the uppermost portion of the trash disposal unit 32 and comprises a two-part tube. The two parts are complementary half-collars, 44, 46, which together form the complete tubular centering collar 42 around the vehicle 10 in the pre-launch stage. By completely surrounding the vehicle 10, the centering collar 42 ensures that the vehicle 10 is centered within the trash disposal unit 32 while preventing the vehicle 10 from knocking against or jamming within the inner wall of the trash disposal unit 32 or the ball valve 40. As to be discussed with reference to FIGS. 3A–3I, the complementary half-collars 44, 46 break away from the vehicle 10 after the vehicle 10 is launched into the water 33.

Figure 5A:
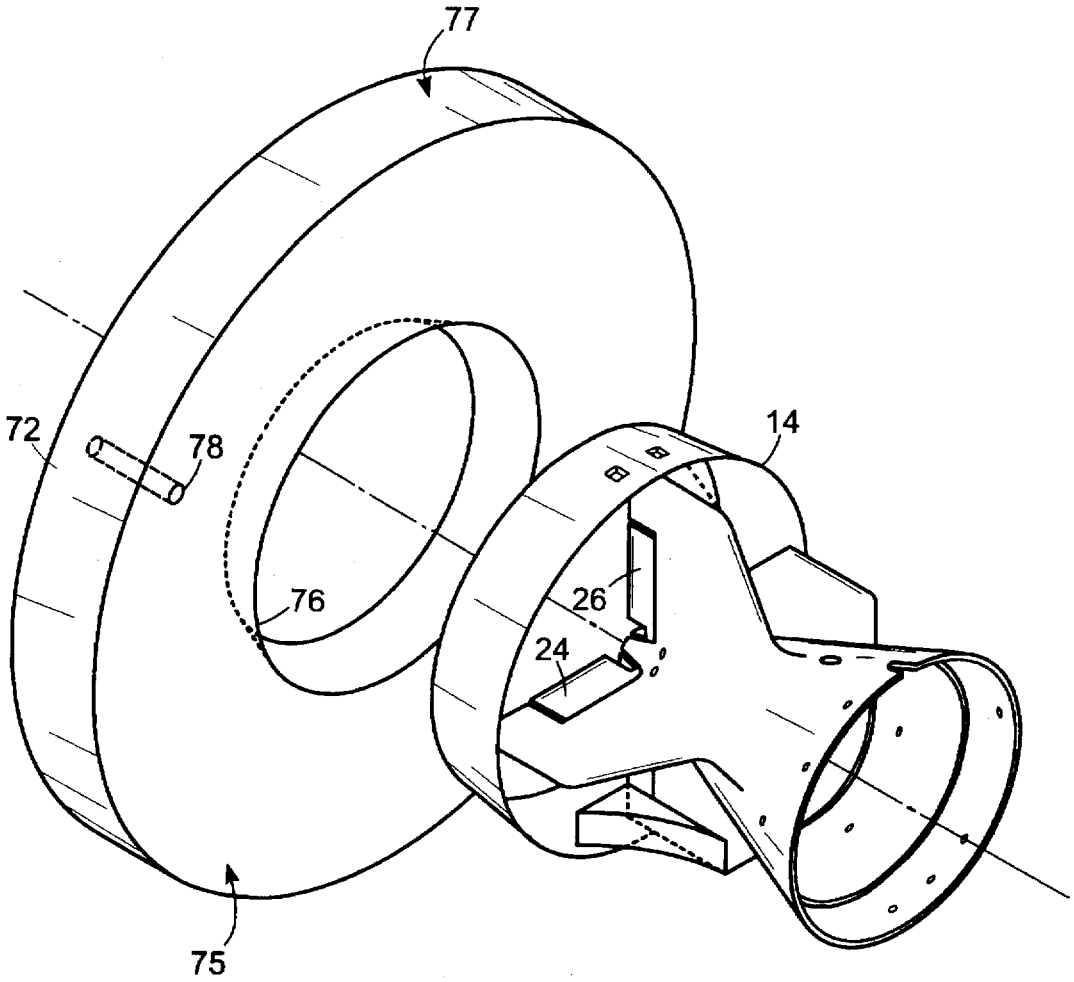
FIG. 5A is a perspective view of one of the launch-aiding components, a descent weight, which fits onto a shroud of the vehicle to aid the vehicle in descending into the body of water to a safe distance away from the submarine at which point the vehicle can begin autonomous operation, the descent weight also acting to dislodge battery sleeve tapes or port seals via a set of connecting lanyards.
Figure 5B:
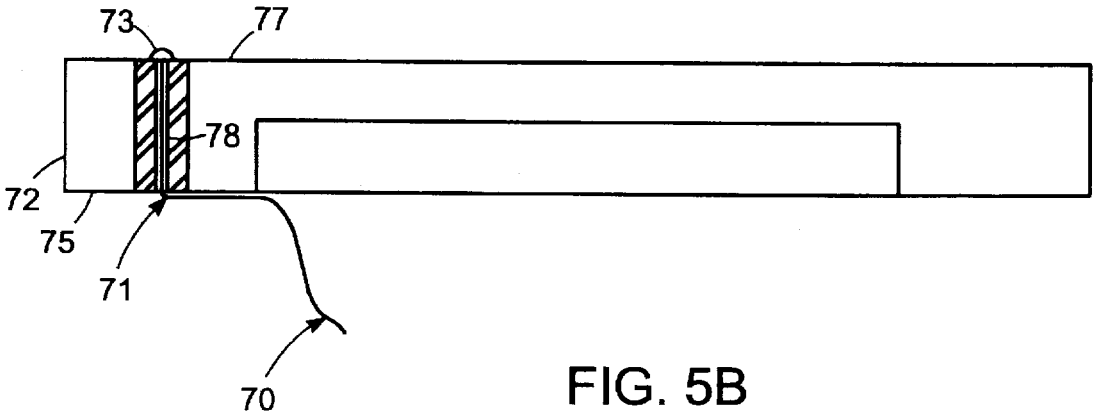
FIG. 5B is a diagram in partial cross-section of the descent weight of FIG. 5A.

Disposed below the centering collar 42, is a centering and support unit 48. The centering and support unit 48, comprised of two complementary sub units 51, 52, forms a tubular member having a top end flange 54 and a bottom end flange 56. Each flange 56 has an opening 58 formed therein. The diameter of an opening 58 in the top end flange 54 is sized to receive the nose 12 of the vehicle 10. Upon insertion of the vehicle 10 into the trash disposal unit 32, the compartment 16 of the vehicle 10 is received within the collar 42, while the nose 12 is received in the opening 58 in the top end flange 54 of the centering and support unit 48. A descent weight 72, to be further described below with reference to FIGS. 5A and 5B, is then attached to the shroud 14 of the vehicle 10. The vehicle 10 is thus retained in place within the TDU until the launch is activated. The vehicle is retained primarily through a friction fit with the wall of the top end flange 54 defining the opening 58. Because the opening 58 is centrally located on the top end flange 54 and is sized to receive the nose 12 of the vehicle 10, the vehicle 10 is centered and supported by the centering and support unit 48 while in the trash disposal unit 32.

Abutting the bottom end flange 56 is a launch cushion 60 which absorbs any shocks within the trash disposal unit 32, thus preventing the vehicle 10 from being jarred while disposed therein. The launch cushion 60 also acts to protect the ball valve 40 which might otherwise be scratched or in some way marred by the process of launching the vehicle 10 from the TDU 32. The launch cushion 60, the centering and support unit 48, the centering collar 42, and the vehicle 10 are secured in place when the ball valve 40 is closed.

Figure 3C:
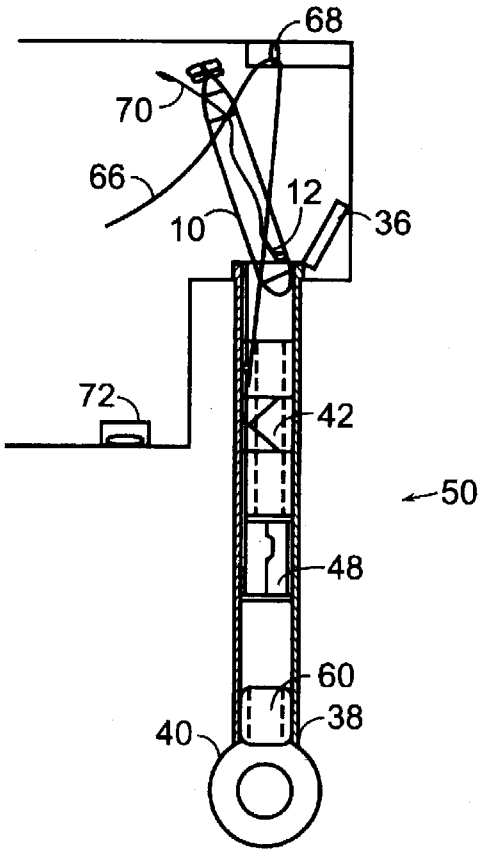
FIGS. 3A–3I are diagrams depicting steps involved in launching the vehicle from the trash disposal unit.
Figure 3B:
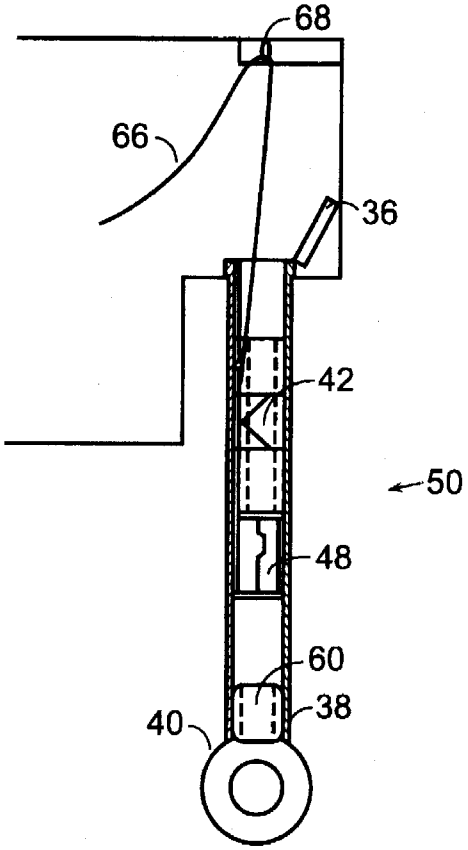
Figure 3A:
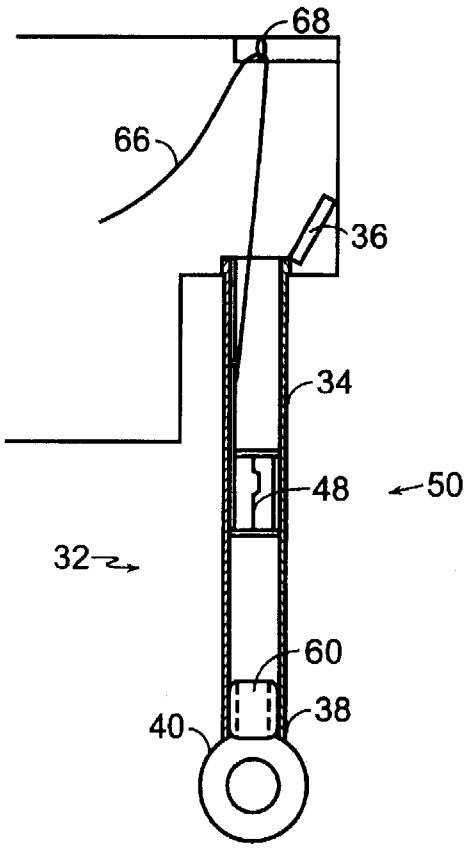

Referring to FIG. 3A, loading the vehicle 10 into the TDU 32 involves first opening the breech door 36 to reveal an empty TDU with the ball valve 40 closed. The launch cushion 60 is then dropped into the TDU, and it falls by gravity down into the TDU until it comes to rest against the ball valve 40. A slip line 66 runs through an attachment 68 (e.g., a hook or padeye) outside of the trash disposal unit 32 and connects to the centering and support unit 48. The lane 66 is used to lower the centering and support unit 48 to a predetermined location within the trash disposal unit 32. After the centering and support unit 48 has been lowered, the slip line 66 is secured to hold the unit 48 at that location within the TDU. The slip line 66 is thus held taught thereby preventing the centering and support unit 48 from moving any further down into the TDU. As the other components (e.g., 48, 42) of the sub-launch assembly 50 are being loaded into the trash disposal unit 32, note that the ball valve 40 remains in a closed position. FIG. 3B shows the centering collar 42 being next inserted into the trash disposal unit 32 until it abuts the centering and support unit 48. At this point, the vehicle 10 can be introduced into the TDU.

Referring to FIG. 3C, the vehicle 10 is inserted, nose 12 first, into the trash disposal unit 32. Attached to the vehicle 10 is a lanyard assembly 70 comprised of a plurality of lanyards 80 having sealing plugs 82 or sealing tape 182 at the ends thereof which plug holes in the battery housing to prevent water from entering and contacting the battery and thus activating the seawater battery. The holes in the battery housing being plugged coupled with the rest of the vehicle body being watertight prevents any water from entering the vehicle 10 while it is being loaded into the TDU, while it is in the TDU waiting to be launched, and after it is removed from the TDU if the launch is aborted.

Figure 3F:
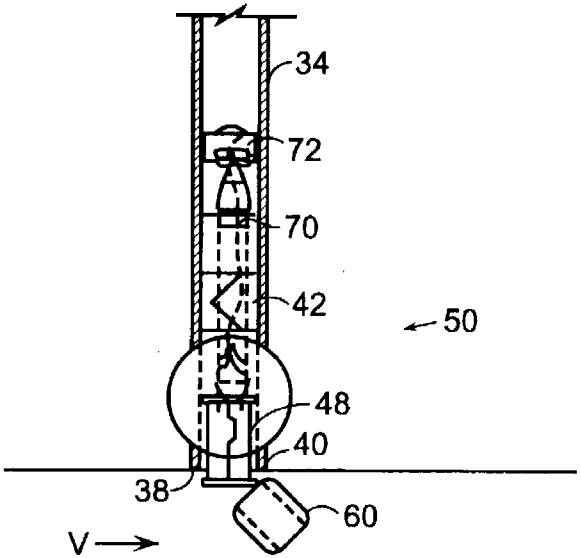
Figure 3E:
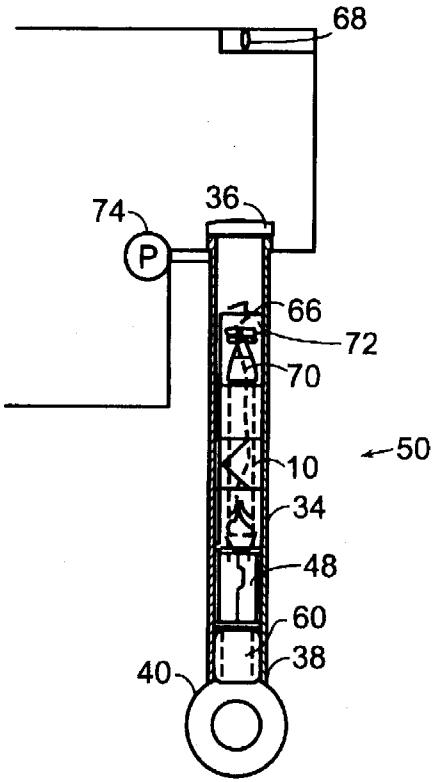
Figure 3D:
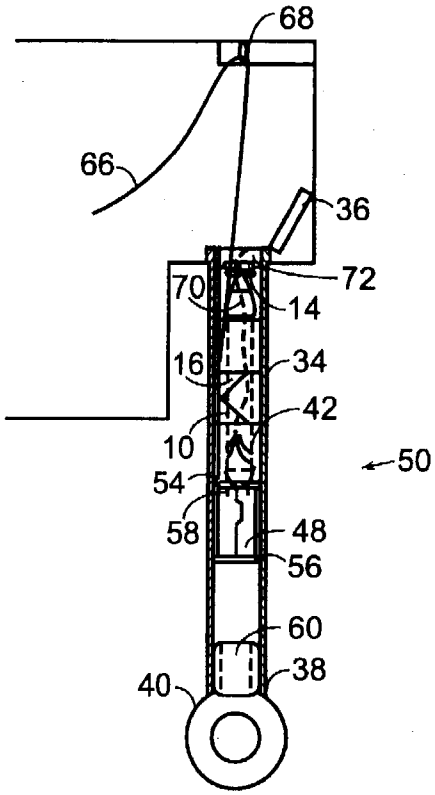

Referring to FIGS. 3D and 3E, the vehicle 10 is lowered into the trash disposal unit 32 such that it passes through the centering collar 42 until the nose 12 of the vehicle 10 is received in the opening 58 in the flange 54 of the centering and support unit 48. The descent weight 72 is placed on, or perhaps more accurately, fitted onto the shroud 14 of the vehicle 10, and the other end of the lanyard assembly 70 away from the battery housing holes is attached to the weight 72. The slip line 66 is then released and used to lower the unit 48, the collar 42, and the vehicle 10 with the weight 72 down into the TDU until the unit 48 contacts the launch cushion 60. In some embodiments, the lowering is not done until the vehicle 10 is about to be launched into the water 33. After lowering, the slip line 66 is removed or allowed to fall into the trash disposal unit 32. The breech door 36 is then shut and the TDU is pressurized/flooded by a valve 74. The pressure is increased within the trash disposal unit 32 such that when the ball valve 40 is subsequently opened, the sub-launch assembly 50 and the vehicle 10 are expelled from the trash disposal unit 32. The force with which the contents of the TDU are expelled together with the increased gravitational force due to attachment of the descent weight 72, causes the vehicle 10 to descend to a safe distance from the submarine 30 where it can begin autonomous operation. If the launch is aborted after the vehicle 10 and components have been lowered and the TDU has been flooded, the TDU can be drained and opened, and the contents thereof can be extracted by using, for example, a retrieval rod.

Referring to FIG. 3F, when it is time to launch, the ball valve 40 is moved into an open position. Once the ball valve 40 is open, the sub-launch assembly 50 and the vehicle 10 are ejected from the trash disposal unit 32 into the water 33. The launch cushion 60 exits first. After leaving the TDU, the launch cushion 60 falls within the water and eventually reaches the floor of the water where it typically remains. As shown in FIG. 3G, the centering and support unit 48 next leaves the trash disposal unit 32 after the launch cushion 60. As the centering and support unit 48 exits the TDU, it separates into its two subunits 51, 52 which fall within the water until they too reach the floor of the water where they typically remain.

Figure 3I:
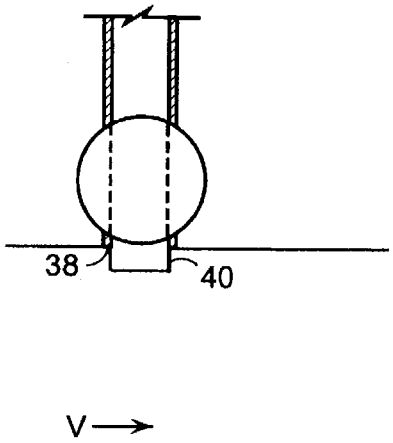
Figure 3I:
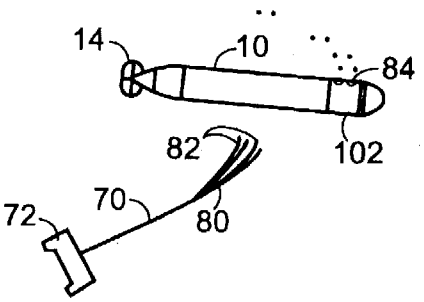
Figure 3H:
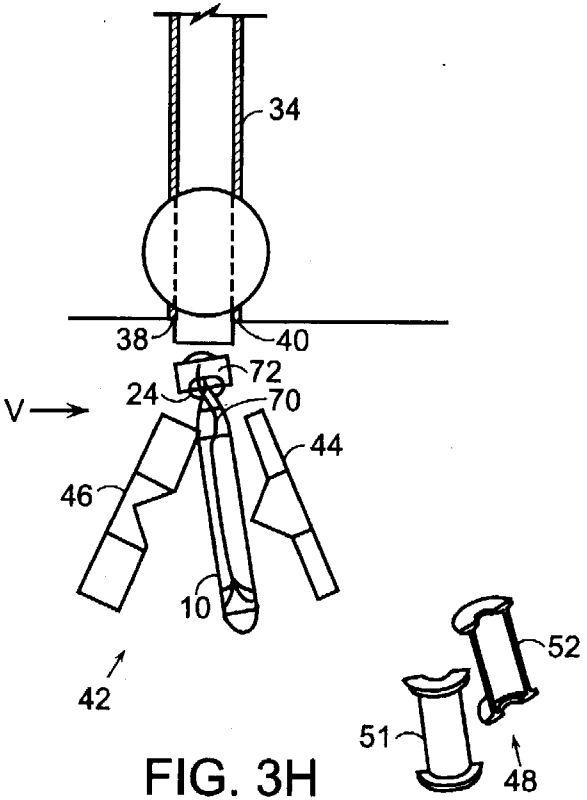
Figure 3G:
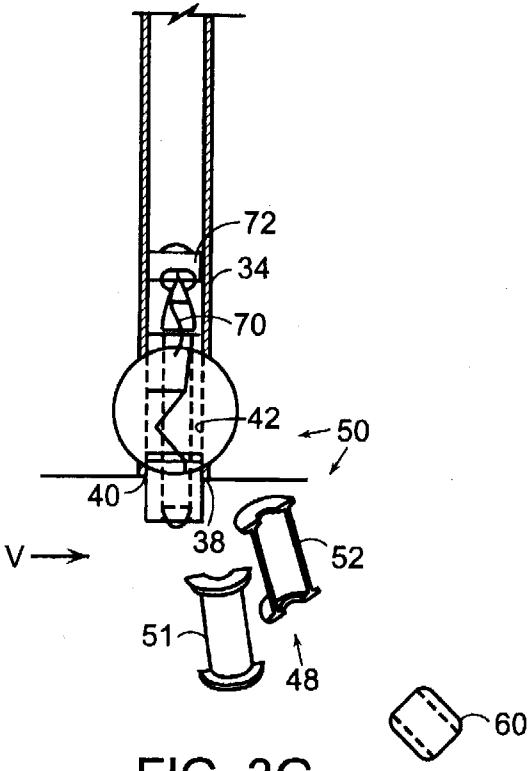

Referring to FIGS. 3H and 3I, the centering collar 42 and the vehicle 10 are expelled from the trash disposal unit 32 together. Aided by the change in pressure and the descent weight 72 attached to the shroud 14, the vehicle 10 descends into the body of water. As the vehicle 10 descends, the centering collar 42 separates into its complementary half collars 44, 46, which break away from the vehicle 10 and fall to the bottom of the body of water where they typically remain. As the vehicle 10 descends to a depth which is a safe distance away from the submarine, the vehicle rotates toward a horizontal position. The descent weight 72 helps to keep the vehicle descending until it has reached the safe distance. At some point in its descent, the vehicle becomes so tilted toward the horizontal that the descent weight 72 falls off of the shroud 14. Because the lanyard assembly 70 is connected to the weight 72, this separation of the weight 72 from the shroud 14 pulls the sealing plugs 82 or the sealing tape 182 from the holes 84 in the battery housing and allows water to enter and contact the battery, as described below with reference to FIGS. 8A and 8B. The descent weight 72 and lanyard assembly 70 then fall to the bottom of the water where they typically remain.

Figure 4:
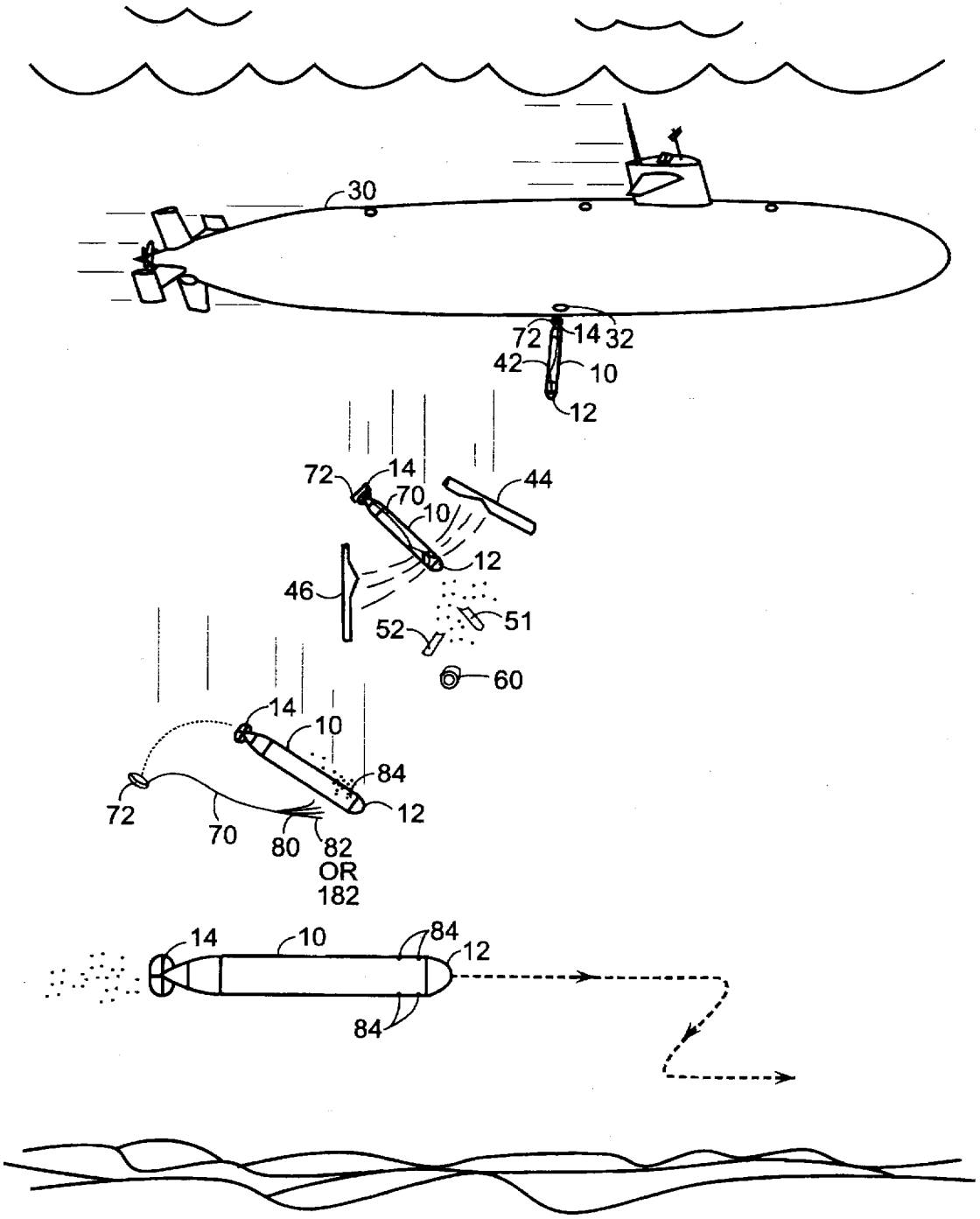
FIG. 4 is a diagram of the vehicle in various stages of deployment from the trash disposal unit of the submarine.

Referring to FIGS. 4 and 5A, with the submarine 30 at a particular depth that allows it to eject items from its TDU, the vehicle and the sub-launch assembly are launched from the TDU into the body of water upon command. After all of the components of the sub-launch assembly have fallen away from the vehicle 10, the vehicle 10 generally has reached a depth that is a safe distance away from the submarine. Upon reaching a depth and position in the water that is sufficient to cause a pressure switch and a pressure transducer in the vehicle 10 to activate (which can be the same as the safe distance mentioned above or a depth somewhat lower than that safe distance), the vehicle comes on-line and becomes operational (i.e., it autonomously moves and simulates targets by generating acoustic signals representative thereof). The descent weight 72 fits onto the shroud 14 of the vehicle 10 to aid the vehicle 10 in descending into the body of water to the safe distance away from the submarine 30. The descent weight 72 can be made of lead or other metal, and it has a counterbored hole 76 in its center. The hole 76 is sized to receive the shroud 14. The inner diameter of the hole 76 is tapered such that the descent weight 72 remains on the shroud 14 until the vehicle tilts so much toward the horizontal that the weight falls off. The mass of the descent weight 72 and the shape of the wall of the counterbored hole 76 are such that the descent weight 72 remains on the shroud 14 until the vehicle has descended to the safe distance away from the submarine 30.

The descent weight 72 has a through-hole 78 formed therein for attaching the lanyard assembly 70. Referring to FIG. 4, notice that the set of lanyards 80 forming the lanyard assembly 70 join to form a single lanyard 71 at the end opposite the sealing tape 182 or sealing plugs 82. Referring to FIG. 5B, the single lanyard 71 is tied to the descent weight 72 via the through-hole 78 such that the movement of the descent weight 72 affects the individual lanyards 80. The through-hole 78 extends from a bottom surface 75 of the descent weight 72 to a top surface 77 thereof. The lanyard 71 extends through the through-hole 78, and an attachment 73 is formed to secure it to the weight 72. Thus, as the descent weight 72 detaches from the shroud 14 (as shown in FIGS. 3I and 4), the descent weight 72 pulls the lanyard assembly 70 away from the vehicle 10. The pulling force causes the sealing plugs 82 or sealing tape 182 connected to the lanyards 80 to become disengaged from the holes 84 in the battery housing 102 thus allowing water to contact the battery, causing activation thereof. Activation of the seawater battery is further described below with reference to FIGS. 8A and 8B.

Figure 6:
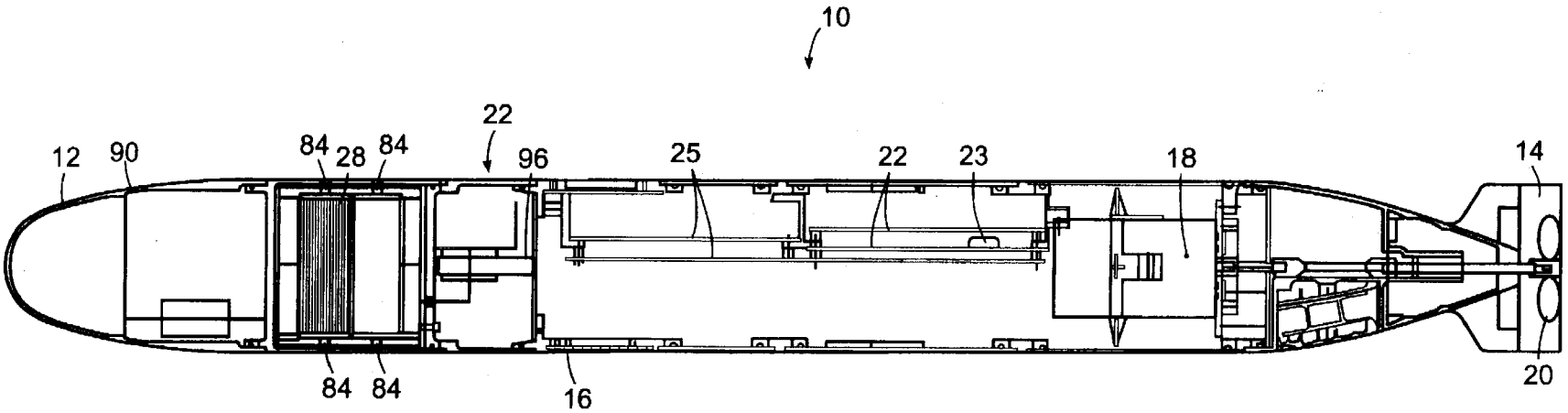
FIG. 6 is a side view of the assembled expendable autonomous underwater vehicle showing various internal modules.

Referring to FIG. 6, located within the forebody section of the vehicle 10 is a nose support plate 90 for strengthening the nose 12. Behind this section is a midbody section which has enclosed therewithin the battery 28 (preferably a seawater battery 100) as well as guidance and control subsystem electronics 22 (which includes the speed control chip 23) and signal processing subsystem electronics 25. The battery 28 provides power to the vehicle 10. The seawater battery 100 is activated by the water 33 which acts as the electrolytic contact therewithin. A guidance and control assembly is located behind the battery 28 and includes a fluxgate compass 96, pressure sensors (not shown), solenoids (not shown), and the guidance and control subsystem electronics 22. A signal processing assembly simulates targets by generating signals representative of the targets and causing corresponding acoustic signals to be transmitted into the water. This signal processing assembly includes the signal processing subsystem electronics 25, a forebody projector (not shown), and at least one midbody projector (not shown). The forebody projector is an acoustic transducer which, under the control of the signal processing subsystem electronics 25, receives acoustic interrogations from an external source (e.g. from an active sonobuoy or some other active sonar system) and then transmits acoustic signals representative of echoes which the target would return. Thus, the forebody projector is an active echo receiver/repeater. The midbody projectors are acoustic transducers which, under the control of the signal processing subsystem electronics 25, generate "noise" that simulates the sound of a running target. The midbody projectors thus generate a passive acoustic signature of the simulated submarine. The DC brush motor 18 is controlled by the guidance and control subsystem electronics 22. The motor 18 is connected to the pulse width modulated speed control microprocessor chip 23 for driving the propeller 20 at varying speeds. The guidance and control subsystem electronics 22 further causes the solenoids to move the elevators 24 and the rudders 26 causing the vehicle 10 to embark on the predetermined course dictated by the guidance and control assembly.

Figure 7:
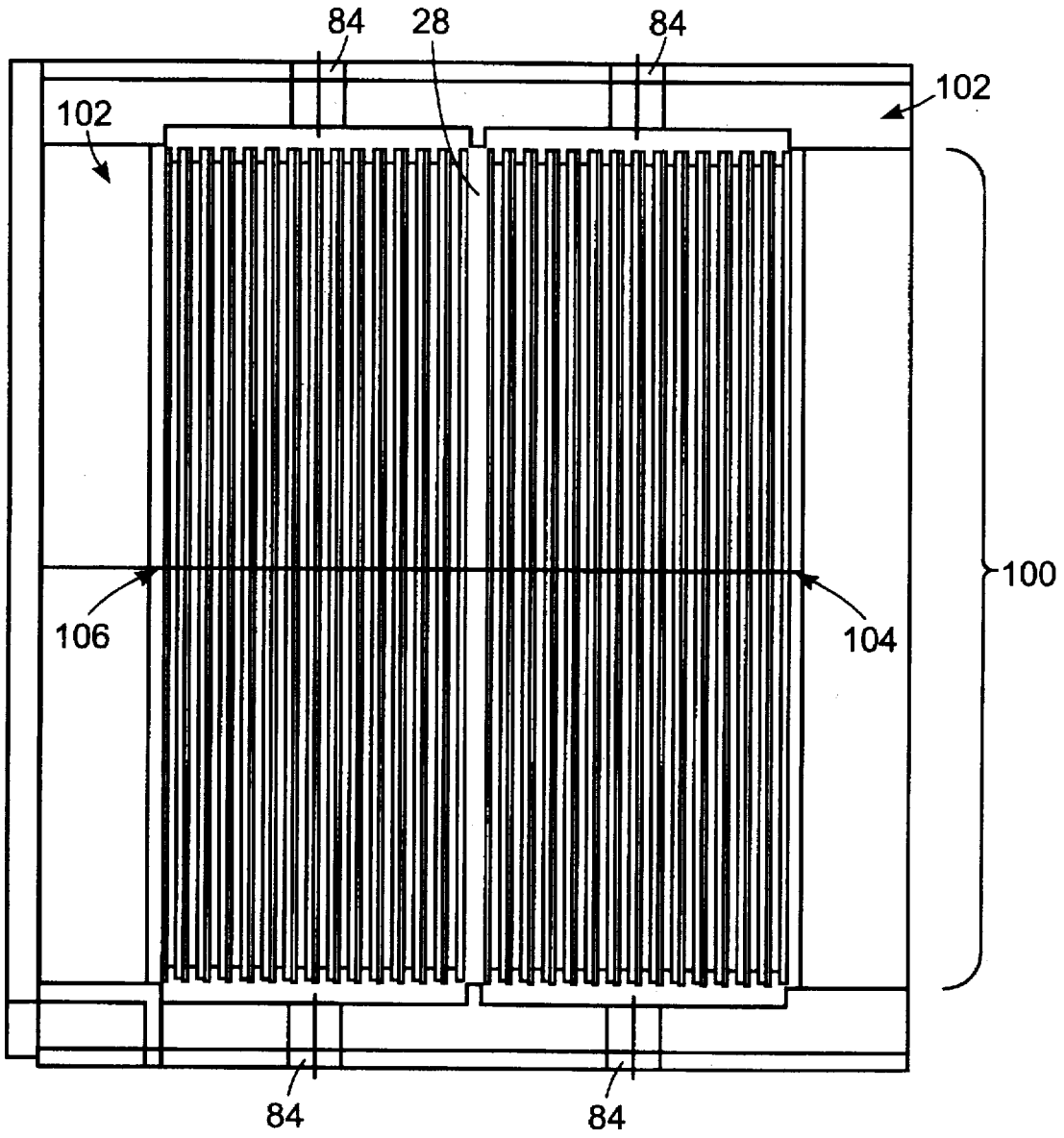
FIG. 7 is a side view of an internal seawater battery of the vehicle of FIG. 6.

Referring to FIG. 7, the battery 28 is a seawater battery 100 surrounded by a battery housing 102. The cathode 104 is preferably comprised of silver chloride, and the anode 106 is preferable comprised of magnesium. The housing 102 has a plurality of holes or battery ports 84 formed therein. Preferably, there are four holes 84, two for allowing water to enter and two for allowing any gas to escape. The holes 84 are sealed until it is time to activate the battery (i.e., until it is time to bring the vehicle 10 on-line), which time more specifically is when the vehicle 10 has reached a safe distance away from the submarine 30.

Figure 8A:
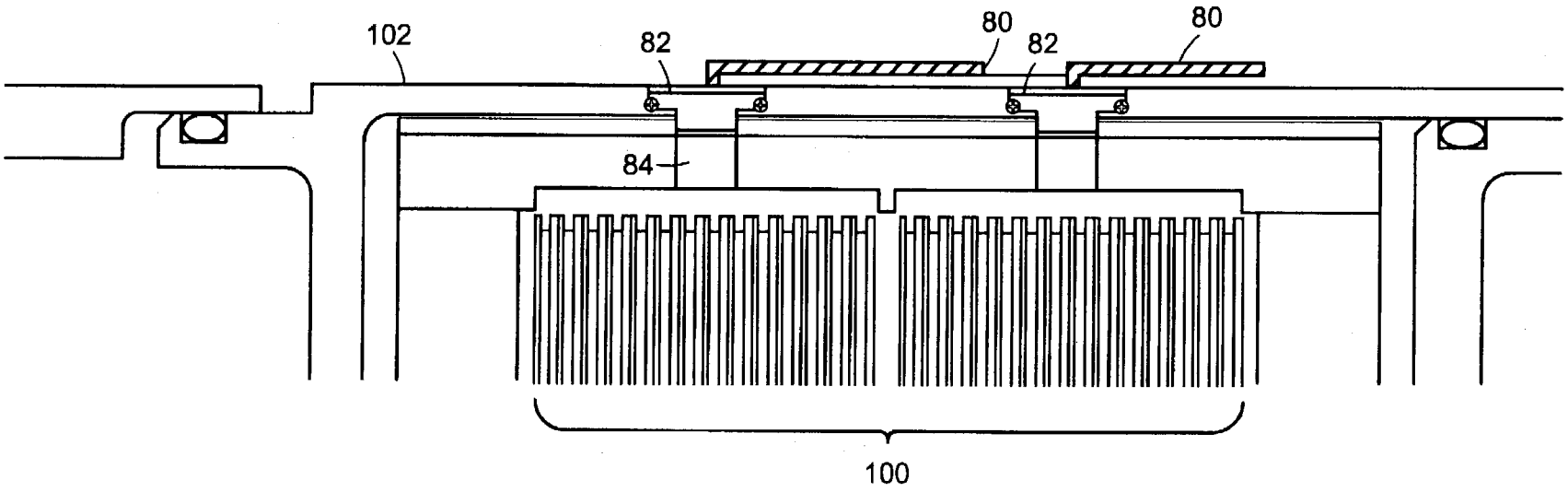
FIG. 8A is a diagram of one arrangement for sealing ports in the battery housing to prevent liquid or gas from entering or exiting the battery compartment until after the vehicle is a safe distance away from the submarine, the arrangement including sealing plugs with attached lanyard.

Referring to FIG. 8A, in some embodiments, water is prevented from contacting the seawater battery 100 by sealing plugs 82 that block the holes 84. The sealing plugs 82 are attached to the set of lanyards 80. When the vehicle 10 is within the trash disposal unit 32, activation of the seawater battery 100 generally is not desirable or allowable because, for example, of the danger presented by gas which might emanate from the battery 100 when water contacts it. With the sealing plugs 82 in place in the holes 84, water is prevented from entering and contacting the seawater battery 100. After the vehicle 10 has been ejected into the body of water, reached a safe distance from the submarine, and achieved a sufficiently horizontal position such that the descent weight 72 falls off of the shroud 14, the sealing plugs 82 are pulled out of the holes 84. At this point, water enters the battery housing 102 via the unplugged holes 84 and contacts the seawater battery 100 to activate it. The water, acting as the electrolytic contact, causes current to flow from the battery 100. Any gas byproducts resulting from the activation of the seawater battery 100 exit through the holes 84. The seawater battery 100 typically is sufficient to power the vehicle for multiple hours depending on the operating speed. After the battery 100 has expired, the vehicle can no longer operate autonomously, and it then drops to the bottom of the water where it is left.

Figure 8B:
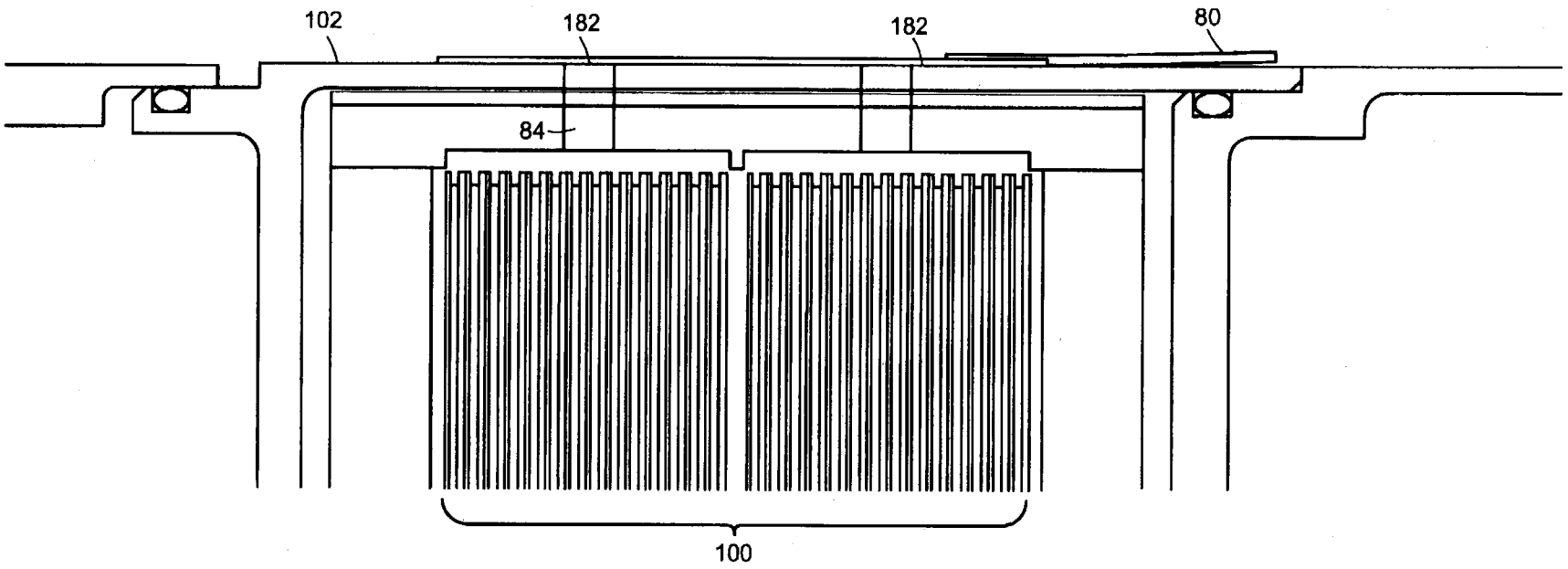
FIG. 8B a diagram of another arrangement for sealing ports in the battery housing to prevent liquid or gas from entering or exiting the battery compartment until after the vehicle is a safe distance away from the submarine, this arrangement including sealing tape with attached lanyard.

Referring to FIG. 8B, in some other embodiments, water is prevented from contacting the seawater battery 100 by sealing tape 182 to covers the holes 84. The sealing tape 182 preferably is a water-resistant adhesive tape. The sealing tape 182 can be configured as a single piece of sealing tape 182 to which are attached each of the lanyards 80. The sealing tape 182 thus provides a single seal extending across each of the battery ports 84. Alternatively, separate strips of sealing tape can be attached to each of the lanyards 80 to seal each of the battery ports individually. The sealing tape 182, like the sealing plugs 82, prevent water from entering the battery housing 102 until activation of the seawater battery 100 is desired.

The present invention enables submarine personnel to conduct training exercises while the submarine is traveling in the water. Coordination of training exercises with a surface ship or aircraft is not required as the trash disposal unit acts as the launcher, and this launcher is completely under the control of the submarine personnel themselves. The launch-aiding components can be provided in the form of a kit. All of the components are expendable as is the vehicle.

Variations, modifications, and other implementations of what is described herein will occur to those of ordinary skill in the art without departing from the spirit and the scope of the invention as claimed. Accordingly, the invention is to be defined not by the preceding illustrative description but instead by the following claims.

What is claimed is:

1. A method of deploying a vehicle into a body of water from a submarine, comprising:

providing an expendable autonomous underwater vehicle;

providing one or more launch-aiding components;

inserting into a trash disposal unit of the submarine the vehicle and the launch-aiding components in an arrangement which keeps the vehicle in a predetermined orientation within the trash disposal unit and which protects the trash disposal unit from damage, aids the vehicle in descending into the body of water to a depth at which the vehicle begins autonomous operation, and allows the launch-aiding components to fall away from the vehicle in the body of water as the vehicle descends thereinto; and ejecting the vehicle and the launch-aiding components from the trash disposal unit into the body of water such that the launch-aiding components fall away from the vehicle in the body of water as the vehicle descends into the body of water to the depth at which the vehicle begins autonomous operation.

2. The method of claim 1 wherein the step of providing the expendable autonomous underwater vehicle comprises providing the vehicle which has a length of about three to four feet and a diameter of about five inches and which includes:

a nose at a front end of the vehicle;

a shroud at a rear end of the vehicle which includes a propeller, elevators, and rudders;

an internal motor for driving the propeller;

actuators for controlling the elevators and the rudders;

an internal guidance and control subsystem for controlling the autonomous operation of the vehicle in the body of water by controlling the motor and the actuators;

an internal signal processing subsystem for simulating a submarine target by generating signals representative of the target and causing corresponding acoustic signals to be transmitted into the body of water; and an internal power source for powering the signal processing subsystem, the guidance and control subsystem, the motor, and the actuators after ejection of the vehicle into the body of water.

3. The method of claim 2 wherein the step of providing the expendable autonomous underwater vehicle further comprises providing the vehicle which further includes a battery housing having at least one port.

4. The method of claim 3 wherein the step of providing the one or more launch-aiding components includes providing means for substantially sealing the ports of the battery housing at least while the vehicle and the launch-aiding components are within the trash disposal unit.

5. The method of claim 2 wherein the step of inserting the vehicle into the trash disposal unit includes inserting first the nose of the vehicle into the trash disposal unit.

6. The method of claim 5 wherein the step of providing the one or more launch-aiding components includes providing means for increasing an in-water weight of the vehicle.

7. The method of claim 6 wherein the step of:

providing means for increasing the in-water weight of the vehicle comprises providing a descent weight; and inserting the vehicle and the launch-aiding components into the trash disposal unit further includes placing the weight on the shroud of the vehicle.

8. The method of claim 7 wherein the step of ejecting the vehicle and the launch-aiding components from the trash disposal unit into the body of water comprises opening a ball valve of the trash disposal unit and allowing the weight to assist in ejecting the vehicle from the trash disposal unit.

9. The method of claim 8 wherein the step of:

placing the weight on the shroud of the vehicle comprises placing the weight on the shroud such that it remains on the shroud until the vehicle is in a predetermined position in the body of water; and opening the trash disposal unit and allowing the weight to assist in ejecting the vehicle from the trash disposal unit includes keeping the weight on the shroud until the vehicle is in the predetermined position in the body of water.

10. A system for deploying a vehicle into a body of water from a submarine, comprising:

a trash disposal unit of the submarine;

an expendable autonomous underwater vehicle; and one or more launch-aiding components for insertion into the trash disposal unit along with the vehicle in an arrangement which keeps the vehicle in a predetermined orientation within the trash disposal unit and which protects the trash disposal unit from damage, aids the vehicle in ejecting from the trash disposal unit and descending into the body of water to a depth at which the vehicle begins autonomous operation, and allows the launch-aiding components to fall away from the vehicle in the body of water as the vehicle descends thereinto to the depth at which the vehicle begins autonomous operation after the vehicle and the launch-aiding components are ejected from the trash disposal unit.

11. The system of claim 10 wherein the expendable autonomous underwater vehicle has a length of about three to four feet and a diameter of about five inches and includes:

a nose at a front end of the vehicle;

a shroud at a rear end of the vehicle which includes a propeller, elevators, and rudders;

an internal motor for driving the propeller;

actuators for controlling the elevators and the rudders;

an internal guidance and control subsystem for controlling the autonomous operation of the vehicle in the body of water by controlling the motor and the actuators;

an internal signal processing subsystem for simulating a submarine target by generating signals representative of the target and causing corresponding acoustic signals to be transmitted into the body of water; and an internal power source for powering the signal processing subsystem, the guidance and control subsystem, the motor, and the actuators after ejection of the vehicle into the body of water.

12. The system of claim 11 wherein vehicle further includes a battery housing having at least one port.

13. The system of claim 12 wherein the launch-aiding components include means for substantially sealing the port's the battery housing at least while the vehicle and the launch-aiding components are within the trash disposal unit.

14. The system of claim 11 wherein the nose of the vehicle is inserted first into the trash disposal unit.

15. The system of claim 14 wherein the launch-aiding components include means for increasing an in-water weight of the vehicle.

16. The system of claim 15 wherein the means for increasing the in-water weight of the vehicle comprises a descent weight placed on the shroud of the vehicle while the vehicle is in the trash disposal unit.

17. The system of claim 16 wherein the descent weight assists in ejecting the vehicle from the trash disposal unit.

18. The system of claim 17 wherein the descent weight is configured to fit into the shroud and remain thereon after ejection until the vehicle is in a predetermined position in the body of water.

19. A system for deploying a vehicle into a body of water from a submarine, comprising:

an expendable autonomous underwater vehicle;

a discharge unit of the submarine, the discharge unit being sized to accommodate the expendable autonomous underwater vehicle and having a door at one end and a ball valve at another end;

a plurality of launch-aiding components disposed within the discharge unit to secure the vehicle therewithin and to protect the discharge unit from damage which might otherwise be caused by the vehicle; and a pressure valve for introducing water into the discharge unit such that when the valve is opened the vehicle and the launch-aiding components are ejected into the body of water away from the submarine;

wherein the vehicle descends into the body of water after ejection from the discharge unit to a safe distance away from the submarine before beginning autonomous operation.

20. The system of claim 19 wherein the expendable underwater vehicle includes:

a battery enclosed within a battery housing having a plurality of ports;

a lanyard assembly having a plurality of seals removably blocking the ports; and a weight removably disposed on an end of the vehicle and coupled to the lanyard assembly.

* * * * *